US006220695B1

(12) United States Patent
Minemoto et al.

(10) Patent No.: US 6,220,695 B1
(45) **Date of Patent: *Apr. 24, 2001**

(54) INK-JET RECORDING DEVICE FOR SUPPRESSING EXCESS ELECTROPHORETIC ACCUMULATION OF CHARGED PARTICLES

(75) Inventors: Hitoshi Minemoto; Yoshihiro Hagiwara; Ryosuke Uematsu; Junichi Suetsugu; Kazuo Shima, all of Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/734,380

(22) Filed: Oct. 17, 1996

(30) Foreign Application Priority Data

Oct. 24, 1995 (JP) ..... 7-275447

(51) Int. Cl.[7] ..... B41J 2/06
(52) U.S. Cl. ..... 347/55
(58) Field of Search ..... 347/5, 55, 112, 347/10, 40, 52; 399/271, 290, 292, 295; 359/55

(56) References Cited

U.S. PATENT DOCUMENTS 4,717,926 1/1988 Hotomi ..... 347/55

FOREIGN PATENT DOCUMENTS 0761441 3/1997 (EP) .
2031344 4/1980 (GB) .
56-167473 * 12/1981 (JP) ..... 347/55
93 11866 6/1993 (WO) .
9311866 6/1993 (WO) .

OTHER PUBLICATIONS

Patent Abstract of Japan, JP–8–174815, Jul. 9, 1996 (NEC-Corp).*

European Examination Report issued Sep. 30 ,1999 in a related application (in English).

* cited by examiner

*Primary Examiner*—Benjamin R. Fuller
*Assistant Examiner*—C. Dickens
(74) *Attorney, Agent, or Firm*—Ostrolenk, Faber, Gerb & Soffen, LLP

(57) ABSTRACT

An electrostatic ink-jet recording device which provides stable printing by preventing too much charged toner from gathering around an ink discharge aperture even if the charged toner has not been discharged for a long time. If the charged toner is not to be discharged, the potential difference between the electrophoretic electrode and the discharge electrode is so controlled as to suppress electrophoretic movement of the charged toner toward the ink discharging aperture, or the potential difference is made zero. If the charged toner is to be discharged, the voltage applied to the discharge electrode is kept lower than the voltage applied to the electrophoretic electrode for a predetermined period of time before discharging a jet of the charged toner.

22 Claims, 5 Drawing Sheets

10

INK-JET RECORDING DEVICE FOR SUPPRESSING EXCESS ELECTROPHORETIC ACCUMULATION OF CHARGED PARTICLES

BACKGROUND OF THE INVENTION

The present invention generally relates to an ink-jet recording device, and particularly, to an electrostatic inkjet recording device in which a recording is achieved by controlling coloring particles in a pigmentary ink through the electrophoretic effect and discharging a jet of coloring particles by means of electrostatic force.

An example of such a recording device is shown in FIG. 1. In FIG. 1, the ink-jet recording device comprises an ink chamber 201 filled with pigmentary ink, an electrophoretic electrode 203 for gathering the coloring particle 206 or charged toner around an ink discharge aperture 202 by means of the electrophoretic effect, and a discharge electrode 205 for discharging a jet of charged toner gathered around the ink discharge aperture toward a recording medium 204 to record on.

The ink chamber 201 is provided within a dielectric member 208. The ink discharge aperture 202 is provided in the dielectric member 208 for communicating the inside and the out side of the ink chamber 201. The discharge electrode 205 has a long and narrow form disposed in the ink discharging direction, and has its end pointed like a needle so as to facilitate electric field concentration on the end. The electrophoretic electrode 203 is fixed as one body on the side and back surfaces of the dielectric member 208. A grounded facing electrode 214 is provided counter the ink discharge aperture 202 via the recording medium 204. The pigmentary ink comprises petroleum organic solvent (isoparaffin) and coloring particles 206 of thermoplastic resin colored with electrification control agent or toner dispersed in the organic solvent. The toner is charged apparently positive by the zeta potential. The recording object 204 is ordinary paper. The electrophoretic electrode 203 and the discharge electrode 205 are connected to a voltage driver (not shown) for applying predetermined voltages with a polarity opposite from that of the coloring particle 206 to the electrodes 203 and 205 in predetermined timing.

FIG. 2 is a diagram showing the voltages applied to the electrophoretic electrode 203 and the discharge electrode 205 in printing operation of the recording device of FIG. 1. In FIG. 2, if a constant voltage V1 is applied to the electrophoretic electrode 203 as shown in FIG. 2A, forming an electric field in the ink chamber 201 filled with pigmentary ink, then the coloring particles 206 in the pigmentary ink moves at an electrophoretic speed toward the ink discharge aperture 202 by the action of the electric field, and eventually gathers around the ink discharge aperture 202. If a pulse voltage V2 with a duration of T2 is applied to the discharge electrode 205 with the coloring particles 206 gathered around the ink discharge aperture, then a jet of coloring ink is discharged in synchronism with the pulse voltage V2 from the ink discharge aperture 202 in the form of a flying particle group 207, which adheres to the recording medium 204. Subsequently, the electric field formed by the electrophoretic electrode 203 causes coloring particles 206 to be supplied to the ink discharge aperture 202. Thus, the discharge of coloring particle is repeated, resulting in a formation of image on the recording medium 204.

However, in the conventional ink-jet recording device as described above, the coloring particles 206 keep moving toward the ink discharge aperture 202 as long as the constant voltage VI shown in FIG. 2 is applied to the electrophoretic electrode 203. If no coloring particle 206 has been discharged from the ink discharge aperture 202 for a long time, then too many coloring particles will gathering around the ink discharge aperture 202, causing an obstruction in the ink discharge aperture 202. This prevents stable discharging of coloring particles 202, having adverse influence on the quality of printed images.

The above and other problems in the prior art are solved and advances are made by the present invention. It is an object of the invention to provide an electrostatic ink-jet recording device for providing a stable printing by preventing too many coloring particles from gathering around the ink discharge aperture.

SUMMARY OF THE INVENTION

According to the invention, an electrostatic ink-jet recording device provides stable printing by preventing too much charged toner or too many coloring particles from gathering around an ink discharge aperture even if the charged toner has not been discharged for a long time. If the charged toner is not to be discharged, the potential difference between the electrophoretic electrode and the discharge electrode is controlled so as to suppress electrophoretic movement of the charged toner toward the ink discharging aperture, or the potential difference is made zero. This prevents the accumulation of too much toner around the ink discharge aperture. If the charged toner is to be discharged, the voltage applied to the discharge electrode is kept lower than the voltage applied to the electrophoretic electrode for a predetermined period of time before discharging a jet of the charged toner. This enables sufficient charged tone to gather around the ink discharge aperture.

BRIEF DESCRIPTION OF THE DRAWINGS

The objects and features of the present invention will become more apparent from the consideration of the following detailed description taken in conjunction with the accompanying drawings, in which.

DESCRIPTION OF THE PREFERRED EMBODIMENTS

Figure 3:
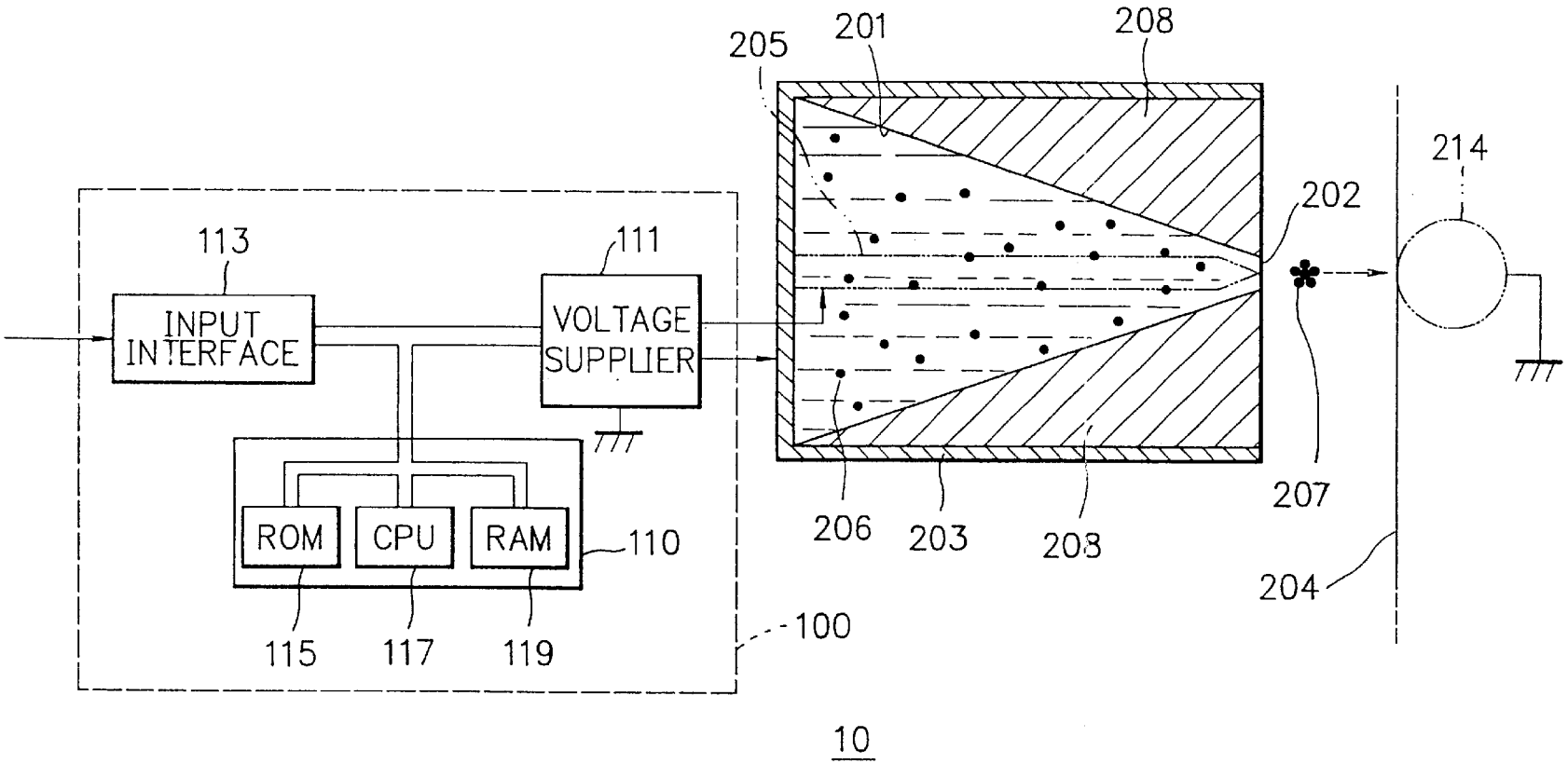
FIG. 3 is a schematic diagram showing a relevant part of an exemplary arrangement of an ink-jet recording device according to the present invention.

Referring to FIG. 3, an illustrative embodiment of the invention will be described in the following.

Figure 1:
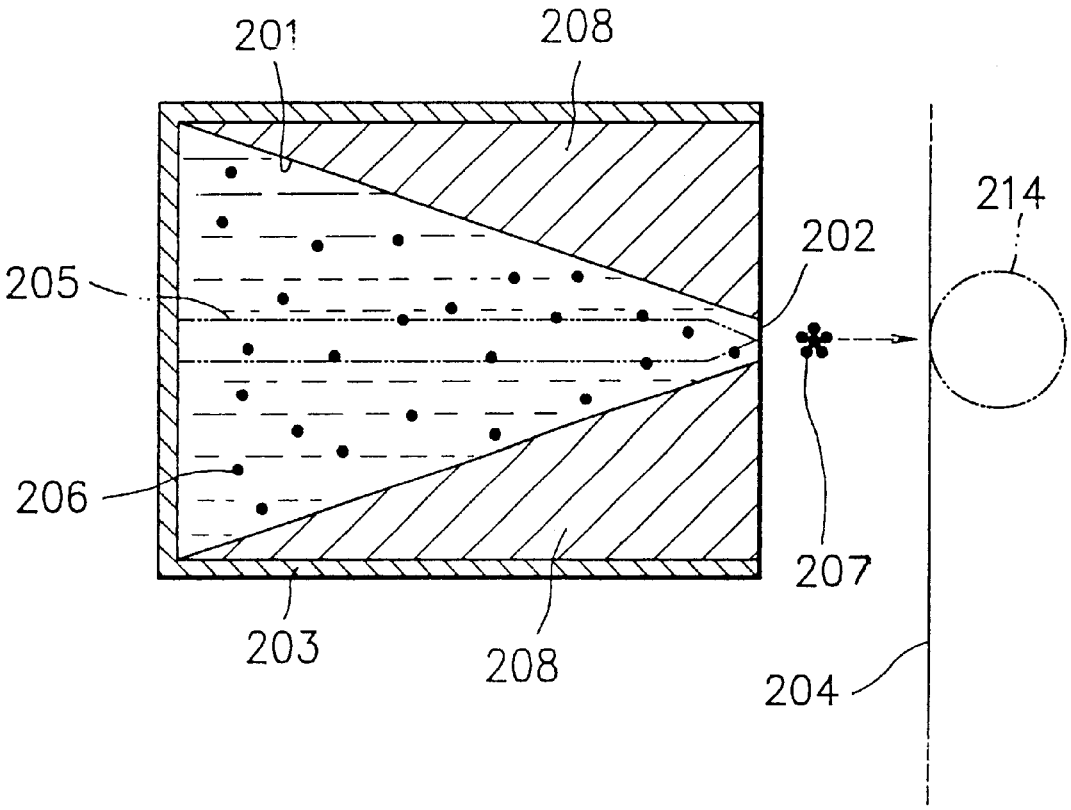
FIG. 1 PRIOR ART
FIG. 1 is a schematic diagram showing a part involved in printing in a conventional ink-jet recording device.
Figure 2A:
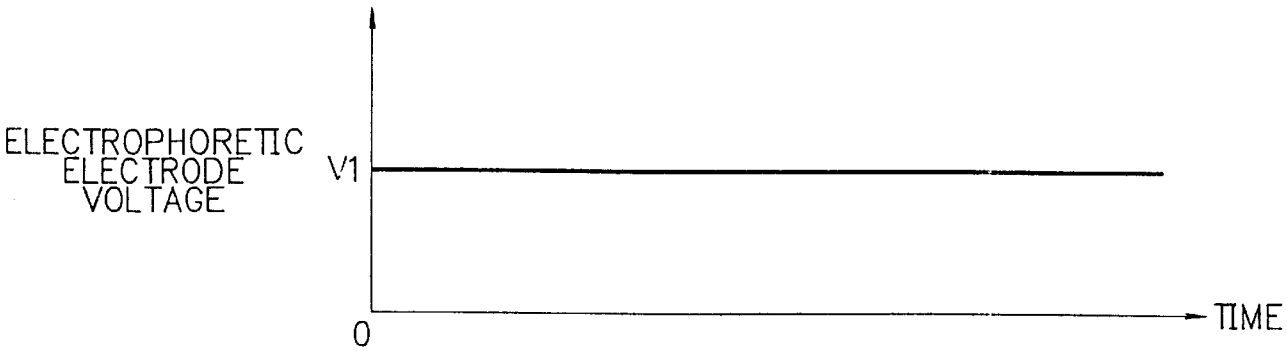
FIG. 2A PRIOR ART
FIGS. 2A and 2B are diagrams showing the voltages applied to the electrophoretic electrode and the discharge electrode in printing operation of the recording device of FIG. 1.
Figure 2B:
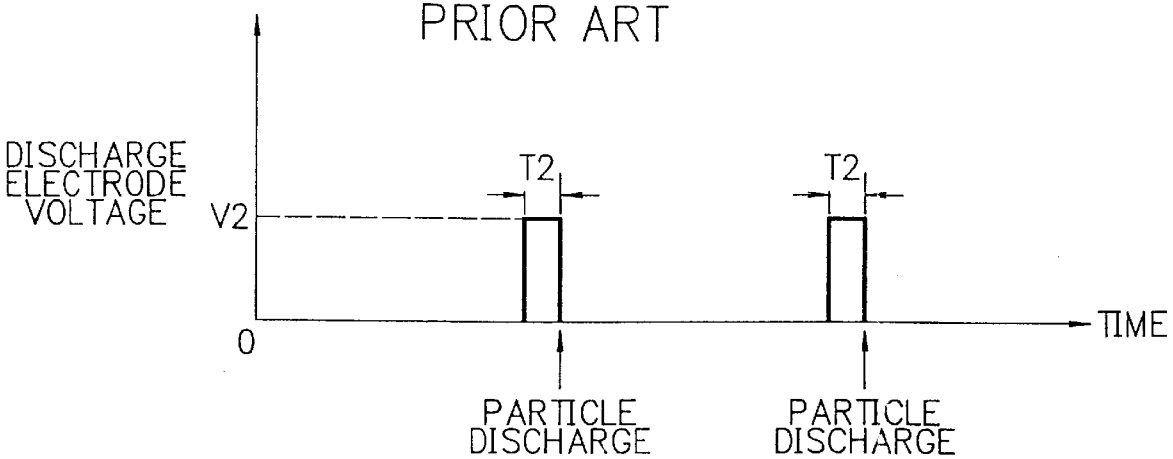
FIG. 2B PRIOR ART

FIG. 3 is a schematic diagram showing a relevant part of an exemplary arrangement of an ink-jet recording device according to the present invention. In FIG. 3, the elements denoted by the same numerals as those of FIG. 1 are identical to corresponding elements of FIG. 1, and accordingly their descriptions are omitted.

As shown in FIG. 3, the controller unit 100 comprises an input interface 113 for receiving printing data including print control codes from an external device (not shown), a voltage supplier 111 connected to the electrophoretic electrode 203 and the discharge electrode 205 for supplying voltages thereto, and a controller 110 connected with the input interface 113 and the electrophoretic electrode 203 via bus lines for analyzing the printing data and giving instructions to the voltage supplier 111. Specifically, the controller 110 comprises a read only memory (ROM) 115 for storing a program for controlling the recording device, a random access memory (RAM) 119 for storing data for use in operation of the recording device, and a central processing unit (CPU) 117 for controlling operation of the recording device under the control of the program stored in ROM 115.

Figure 4:
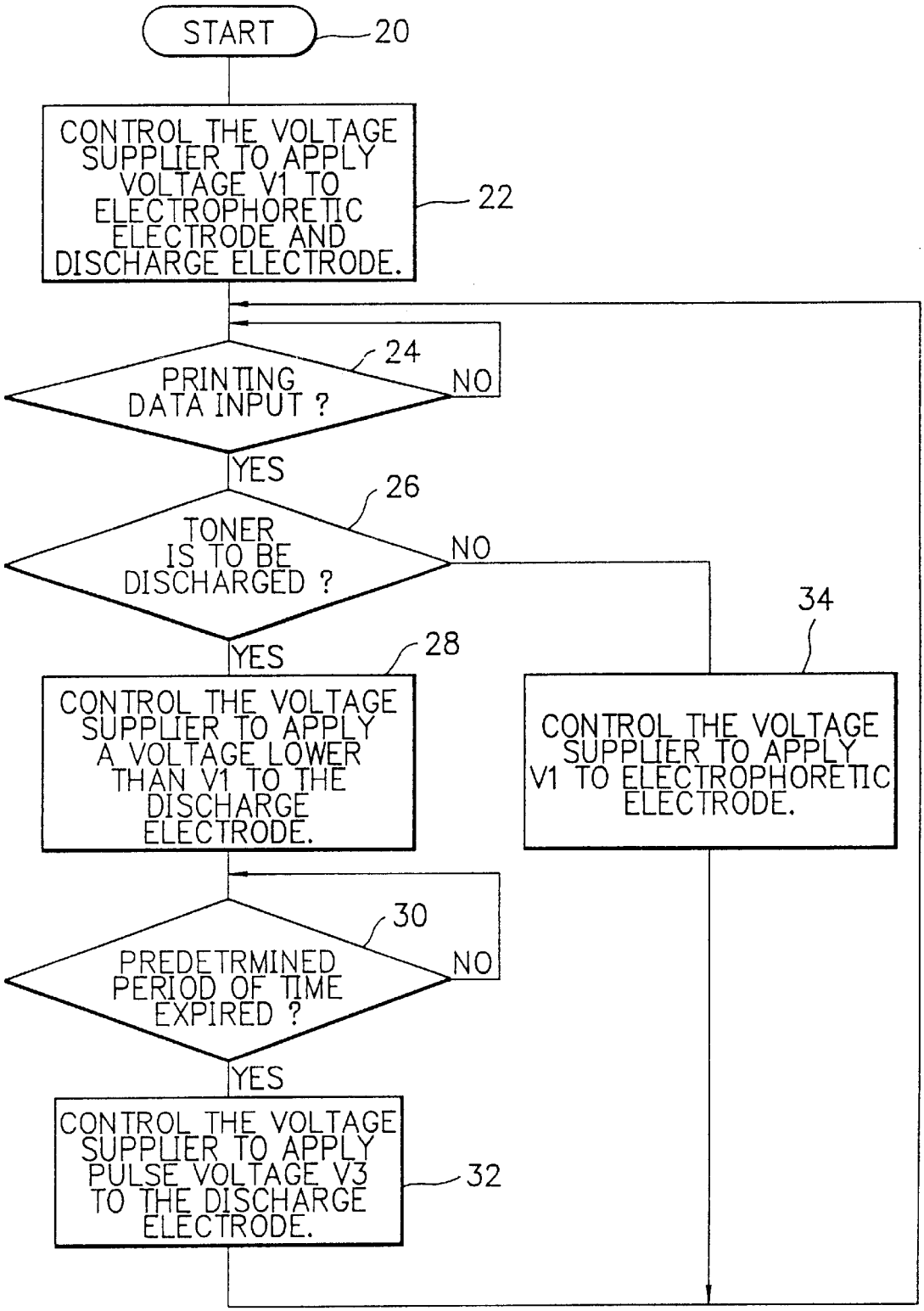
FIG. 4 is a flow chart showing a flow of operation executed by a controller under the control of a program stored in a ROM.
Figure 5A:
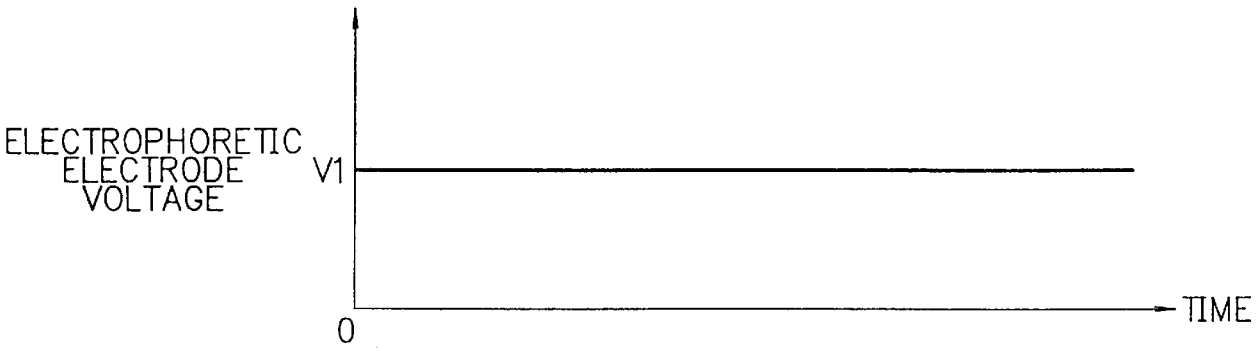
FIGS. 5A and 5B are diagrams showing the voltages applied to the electrophoretic electrode and the discharge electrode in printing operation of the controller unit of FIG. 3.
Figure 5B:
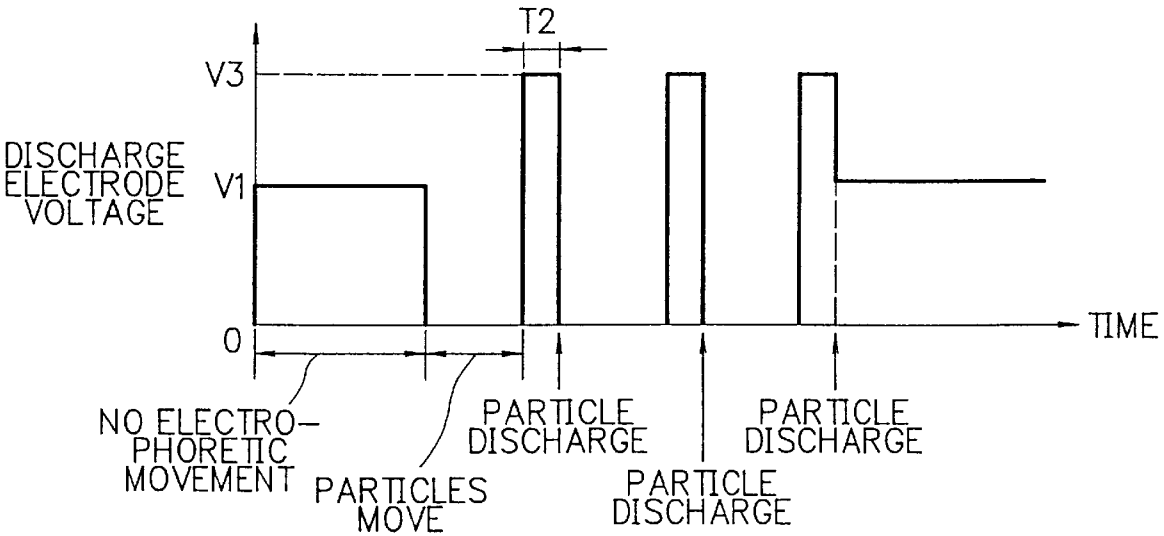

Referring to FIGS. 4 and 5, operation of the ink-jet recording device 10 of FIG. 3 will now be described. FIG. 4 is a flow chart showing a flow of operation executed by the controller 110 under the control of a program stored in the ROM 115. FIG. 5 is a diagram showing the voltages applied to the electrophoretic electrode 203 and the discharge electrode 205 in a printing operation of the controller unit 100 of FIG. 3. In FIG. 4, when the ink-jet recording device 10 is activated, the controller 110 enters the flow at step 20, and proceeds to step 22, where the CPU 117 controls the voltage supplier 111 to apply a voltage V1 of the same polarity as the coloring particles 206 have to the electrophoretic electrode 203 and the discharge electrode 205. At this time, no electric field is formed between the electrophoretic electrode 203 and the discharge electrode 205, causing no electrostatic force to act on the coloring particles 206 in the ink. In step 24, a check is made to see if any printing data has been input. If not, the flow returns to step 24. If the answer is YES in step 24, the controller 110 analyzes the input printing data to see if a jet of toner is to be discharged in step 26. If so, the controller 110 proceeds to step 28, where the controller 110 controls the voltage supplier 111 to supply the discharge electrode 205 with a voltage lower than the voltage V1, e.g., 0V in this embodiment. This causes an electric field to be formed between the electrophoretic electrode 203 and the discharge electrode 205 causing the coloring particles 206 in the ink to gather around the ink discharge aperture 202 by means of the electrophoretic effect. Then, the controller 110 waits for a predetermined period of time in step 30. If the predetermined period of time has elapsed, the controller 110 proceeds to step 32 to control the voltage supplier 111 to apply a pulse voltage of a value V3 with a pulse width of T2 to the discharge electrode 205 in step 32. The predetermined period of time is preferably set for long enough time period to permit a sufficient quantity of coloring particles to gather around the ink discharge aperture 203. Once a pulse voltage V3 is applied to the discharge electrode 205, an electric field is formed between the discharge electrode 205 and the facing electrode 214, a group of coloring particles 206 are pulled apart from the top of the ink meniscus into a group of flying particle 207 to adhere to the recording medium 204 forming a dot. Subsequently, with movement of the recording medium 204, the procedures from step 24 to step 32 are repeated resulting in a desired printing pattern on the surface of the recording medium. On the other hand, if the answer is NO in step 26, the controller 110 controls, in step 34, the voltage supplier 111 to supply the discharge electrode 205 with the voltage V1 which is equal to the voltage applied to the electrophoretic electrode 203. This stops the formation of the electric field between the electrophoretic electrode 203 and the discharge electrode 205, and accordingly the electrophoretic movement of the coloring particles 206, thereby preventing too many coloring particles 206 from gathering around the ink discharge aperture 202. After completing the action of step 34, the controller returns to step 24.

As described above, stopping charged particles 206 from gathering around the ink discharge aperture 202 while coloring particles are not to be discharged prevents too many coloring particles from gathering around the ink discharge aperture, resulting in a stability of printed image without a catch in the ink discharge aperture 202.

Further, if coloring particles 206 are to be discharged in printing, the discharge of coloring particles 206 is guaranteed because coloring particles are gathered around the ink discharge aperture 202 in advance.

The voltage applied to the electrophoretic electrode 203 is always kept a constant value V1 even when the electrophoretic movement of coloring particles is stopped, which eliminates the need of a complicated control system for controlling the voltage applied to the electrophoretic electrode 203. This contributes to a simplification of the control system and accordingly a reduction in cost.

It is noted that the voltage which is applied to the discharge electrode 205 a predetermined period of time before the discharge of coloring particles 206 has not to be necessarily zero, if it is lower than the voltage applied to the electrophoretic electrode 203.

Though the present invention has been described with reference to the particular illustrative embodiments, it is not to be restricted by those embodiments but only by the appended claims. It is to be understood that those skilled in the art can change or modify the embodiments without departing from the scope and spirit of the present invention.

What is claimed is:

1. A method for controlling the operation of an electrostatic ink jet printing device of the type including a printing head comprising an ink chamber for housing an ink containing charged toner, an ink discharge port through which ink contained in said chamber may be ejected from said printing head, an electrophoretic electrode and a discharge electrode, said method comprising the acts of:

monitoring an input signal which indicates whether or not ink is to be ejected form said chamber;

controlling an electric field between said electrophoretic and discharge electrodes when said input signal indicates that ink is not to be ejected from said chamber so that said charged toner is not caused to collect around said ink discharge port; and controlling said electric field between said electrophoretic and discharge electrodes when said input signal indicates that ink is to be ejected from said chamber so that toner first accumulates at said ink discharge port for a sufficient period of time to permit a desired amount of charged toner to accumulate at said ink discharge port and thereafter ink is ejected through said ink discharge port.

2. The method of claim 1, wherein said electric field is controlled when said input signal indicates that ink is to be ejected from said chamber by:

causing the difference between voltages applied to said electrophoretic and discharge electrodes to be at a first level for a predetermined period of time which causes toner particles to accumulate at said discharge port; and thereafter causing the difference between said voltages applied to said electrophoretic and discharge electrodes to be a second level which causes at least some of said toner particles which have accumulated at said discharge port to be ejected from said discharge port.

3. The method of claim 2, wherein said voltage differences are created by maintaining said voltage applied to said electrophoretic electrode at a constant level and varying the level of said voltage applied to said discharge electrode.

4. The method of claim 2, wherein said difference between said voltages applied to said electrophoretic and discharge electrodes is maintained at said first level by causing said voltage level applied to said discharge electrode to be lower than said voltage level applied to said electrophoretic electrode.

5. The method of claim 4, wherein said difference between said voltages applied to said electrophoretic and discharge electrodes is maintained at said second level by causing the voltage level applied to said discharge electrode to be higher than the level of said voltage applied to said electrophoretic electrode.

6. The method of claim 1, wherein a voltage difference between said electrophoretic and said discharge electrodes is caused to be zero when said input signal indicates that ink is not to be discharged from said ink chamber.

7. The method of claim 6, wherein said electric field is controlled when said input signal indicates that ink is to be ejected from said chamber by:

causing the difference between voltages applied to said electrophoretic and discharge electrodes to be at a first level for a predetermined period of time which causes toner particles to accumulate at said discharge port; and thereafter causing the difference between said voltages applied to said electrophoretic and discharge electrodes to be at a second level which causes at least some of said toner particles which have accumulated at said discharge port to be ejected from said discharge port.

8. The method of claim 7, wherein said voltage differences are created by maintaining said voltage applied to said electrophoretic electrode at a constant level and varying the level of said voltage applied to said discharge electrode.

9. The method of claim 7, wherein said difference between said voltages applied to said electrophoretic and discharge electrodes is maintained at said first level by causing said voltage level applied to said discharge electrode to be lower than said voltage level applied to said electrophoretic electrode.

10. The method of claim 9, wherein said difference between said voltages applied to said electrophoretic and discharge electrodes is maintained at said second level by causing said voltage level applied to said discharge electrode to be higher than that applied to said electrophoretic electrode.

11. The method of claim 7, wherein said step of causing said difference between said voltages applied to said electrophoretic and discharge electrode to be at a second level comprises the step of applying a voltage pulse to said discharge electrode.

12. An electrostatic ink jet printing device for ejecting toner, said device comprising:

(A) a printing head including an ink chamber for housing an ink containing charged toner, an ink discharge port through which ink contained in said chamber may be ejected from said printing head, an electrophoretic and a discharge electrode; and (B) a controller coupled to the printing head, the controller monitoring an input signal which indicates whether or not ink is to be ejected from said chamber, the controller controlling an electric field between aid electrophoretic and discharge electrodes when said input signal indicates that ink is not to be ejected from said chamber so that said charged toner is not caused to collect around said ink discharge port, and the controller controlling said electric field between said electrophoretic electrode and said discharge electrode when said input signal indicates that ink is to be ejected from said chamber so that toner first accumulates at said ink discharge port for a sufficient period of time to permit a desired amount of charged toner to accumulate at said ink discharge port and thereafter ink is ejected through said ink discharge port.

13. The ink jet printing device of claim 12, wherein said controller controls said electric field when said input signal indicates that ink is to be ejected from said chamber by controlling said electric field to cause a difference between voltages applied to said electrophoretic and discharge electrodes to be at a first level for a predetermined period of time which causes said toner particles to accumulate at said discharge port, and thereafter controlling said electric field to cause said difference between said voltages applied to said electrophoretic and discharge electrodes to be at a second level which causes toner particles which have accumulated at said discharge port to be ejected from said discharge port.

14. The in jet printing device of claim 13, wherein said voltage differences are created by maintaining said voltage applied to said electrophoretic electrode at a constant level and varying the level of said voltage applied to said discharge electrode.

15. The ink jet printing device of claim 13, wherein said difference between said voltages applied to said electrophoretic and discharge electrodes is maintained at said first level by causing said voltage level applied to said discharge electrode to be lower than said voltage level applied to said electrophoretic electrode.

16. The ink jet printing device of claim 15, wherein said difference between the voltages applied to said electrophoretic and discharge electrodes is maintained at said second level by causing said voltage level applied to said discharge electrode to be higher than that applied to said electrophoretic electrode.

17. The ink jet printing device of claim 12, wherein said controller causes a voltage difference between said electrophoretic and said discharge electrodes to be zero when said input signal indicates that ink is not to be discharged from said ink chamber.

18. The ink jet printing device of claim 17, wherein said controller controls said electric field when said input signal indicates that ink is to be ejected form said chamber by:

causing said difference between said voltages applied to said electrophoretic and discharge electrodes to be at a first level for a predetermined period of time which causes said toner particles to accumulate at said discharge port; and thereafter causing said difference between said voltages applied to said electrophoretic and discharge electrodes to be at a second level which causes at least some of said toner particles which have accumulated at said discharge port to be ejected from said discharge port.

19. The ink jet printing device of claim 18, wherein said controller creates said voltage differences by maintaining the voltage applied to said electrophoretic electrode to be constant and varying the voltage applied to said discharge electrode.

20. The ink jet printing device of claim 19, wherein said controller causing said difference between said voltages applied to said electrophoretic and discharge electrode to be at a second level by applying a voltage pulse to said discharge electrode.

21. The ink jet printing device of claim 18, wherein said controller-maintains said difference between the voltages applied to said electrophoretic and discharge electrodes at said first level by causing said voltage level applied to said discharge electrode to be lower than said voltage level applied to said electrophoretic electrode.

22. The ink jet printing device of claim 21, wherein said controller maintains said difference between said voltages applied to said electrophoretic and discharge electrodes at said second level by causing said voltage level applied to said discharge electrode to be higher than that applied to said electrophoretic electrode.

* * * * *